US006788134B2

(12) United States Patent
Secareanu

(10) Patent No.: US 6,788,134 B2
(45) Date of Patent: Sep. 7, 2004

(54) LOW VOLTAGE CURRENT SOURCES/ CURRENT MIRRORS

(75) Inventor: Radu M. Secareanu, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/325,180

(22) Filed: Dec. 20, 2002

(65) Prior Publication Data

US 2004/0119527 A1 Jun. 24, 2004

(51) Int. Cl.[7] ..... G05F 1/10
(52) U.S. Cl. ..... 327/543; 327/538; 323/315
(58) Field of Search ..... 327/538, 539, 327/540, 541, 542, 543; 323/312, 315

(56) References Cited

U.S. PATENT DOCUMENTS 4,329,639 A 5/1982 Davis
5,047,706 A 9/1991 Ishibashi et al.
5,252,910 A 10/1993 Agaesse
5,311,146 A 5/1994 Brannon et al.
5,357,188 A 10/1994 Takeda et al.
5,384,740 A * 1/1995 Etoh et al. ..... 365/189.09
5,598,094 A 1/1997 Kiehl et al.
5,629,614 A * 5/1997 Choe et al. ..... 323/315
5,640,681 A 6/1997 Barrett, Jr. et al.
5,672,993 A 9/1997 Runaldue
5,680,037 A 10/1997 Carobolante
5,680,038 A 10/1997 Fiedler
5,694,033 A 12/1997 Wei et al.
5,703,478 A 12/1997 Main
5,847,556 A 12/1998 Kothandaraman et al.
5,847,597 A * 12/1998 Ooishi et al. ..... 327/543
5,959,446 A 9/1999 Kuckreja
5,973,549 A * 10/1999 Yuh ..... 327/541
5,977,759 A 11/1999 Sitch
5,986,507 A 11/1999 Itakura et al.
6,002,243 A * 12/1999 Marshall ..... 323/313
6,057,727 A 5/2000 Dautriche et al.
6,064,267 A 5/2000 Lewyn
6,066,944 A 5/2000 Sakurai
6,107,789 A 8/2000 Fryer et al.
6,118,266 A 9/2000 Manohar et al.
6,124,705 A 9/2000 Kwong
6,201,436 B1 * 3/2001 Hur et al. ..... 327/543
6,377,114 B1 * 4/2002 Sakurai ..... 327/543
6,496,057 B2 * 12/2002 Wada et al. ..... 327/543
6,518,833 B2 * 2/2003 Narendra et al. ..... 327/541

* cited by examiner

*Primary Examiner*—Terry D. Cunningham
(74) *Attorney, Agent, or Firm*—Ingrassia Fisher & Lorenz PC

(57) ABSTRACT

A current generator circuit and method capable of operating with a power supply voltage of less than two $V_T$ utilizing a reference transistor and a buffer transistor, each transistor having a source, a drain, and a gate, the drain of the reference transistor coupled to the source of the buffer transistor, the drain of the buffer transistor adapted to be coupled to a power supply, a bias circuit coupled to the drain of the reference transistor and the source of the buffer transistor, and an amplifier coupled to the bias circuit to provide a feedback voltage substantially independent of the voltage of the power supply and sufficient to maintain the reference transistor in constant bias.

14 Claims, 5 Drawing Sheets

- PRIOR ART -

- PRIOR ART -

LOW VOLTAGE CURRENT SOURCES/ CURRENT MIRRORS

FIELD OF THE INVENTION

The present invention generally relates to low voltage current sources and current mirrors, and more particularly relates to low voltage current sources and current mirrors that are highly stable under varying external loads.

BACKGROUND OF THE INVENTION

In the past, the required power supply voltage of semiconductor circuits dropped constantly as semiconductor technology progressed. This power supply reduction has been required for fundamental device and technology reasons, as well as for higher level circuit and system requirements. The drop in the required power supply voltage for analog circuits has lagged the drop in the power supply voltage for digital circuits, and solutions have been sought to fill this gap between the two categories of circuits to make both analog and digital circuits operate at a similar power supply, particularly in those cases where both analog and digital circuits are present on the same semiconductor integrated circuit.

Future generation technologies and applications raise complex challenges for a further reduction in the power supply voltage. The requirements with respect to fundamental device physics on one hand, and fundamental circuit and system restrictions on the other hand, oppose each other when the ultimate possible limits for power supply voltage reduction for next generation technologies are pursued. The principal reason that generates this contradiction is that this evaluation is made with reference to the present state of the art. In addition, system-on-a-chip (SOC) total integration circuitry generates additional challenges in achieving the power supply voltage reduction goals for the next generation technologies and applications. According to SOC requirements, analog, RF, digital, and memory blocks must all coexist on-chip while operating at the same power supply voltage and interacting minimally (such as generating minimal noise and being highly immune to the received noise). To overcome these challenges, novel devices and/or a novel circuit/system design approach must be developed.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Specifically, the present invention provides current sources/current mirrors (or more generically, current sources) of different accuracies that operate at low power supply voltages with large output voltage swings. Therefore, highly constant currents are obtained when the necessary voltage "head-room" is reduced to minimum. By head-room is meant that voltage necessary to operate a circuit above the required signal level. That is, if a power supply of two volts is available, and an output signal swing of 1.4 volts is required, the power supply voltage remaining to operate the circuit itself, including necessary transistor voltage drops, is only 0.6 volts. Thus, in the absence of an output voltage, the entire circuit must be capable of operating with only 0.6 volts, the 0.6 volts being therefore the bias head-room.

This fundamental circuit requirement is the basis of the novel current mode circuit design approach of the instant invention. Based on this novel circuit design approach, novel analog/RF circuits operating at low power supply with high performances are possible. In addition, by using the present invention in well established circuits that are presently in use, the power supply requirement is greatly reduced while the performances of the circuits are substantially improved. Through the use of the methods and apparatus of the instant invention it is possible to design analog/RF circuits operating at a power supply between $1.5V_T$ and $3V_T$ with high overall performances (where $V_T$ is a transistor threshold voltage drop).

Figure 1:
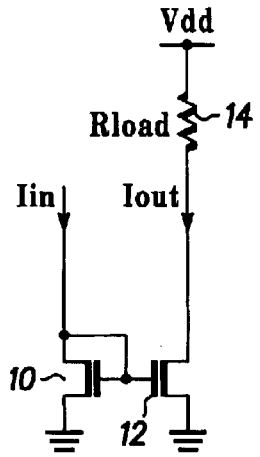
FIG. 1 is a prior art current mirror/current source circuit.

A simple current source/current mirror is shown in FIG. 1. An input current is applied to the drain of a first transistor 10. The gate of transistor 10 is coupled to its drain as well. A second transistor 12 has its gate coupled to the gate of transistor 10 and its drain coupled through a load resistance 14 to a source of power $V_{dd}$. Note that $I_{out}$ is defined by the following equation:

$$I_{DS} = \frac{\mu_N C_{ox}}{2} - \frac{W}{L}(V_{GS} - V_T)^2(1 + \lambda V_{DS})$$

where $I_{DS}$ is $I_{out}$, $\mu$ is the mobility of electrons, $C_{ox}$ is oxide capacitance, W and L are the width and length of the transistor channel, $V_{GS}$ is the gate to source voltage drop, VT is the transistor threshold voltage, $\lambda$ is the channel length modulator and $V_{DS}$ is the drain-source voltage drop. All the variables refer to transistor 12 of FIG. 1.

Particularly for low voltage applications where $(V_{GS}-V_T)$ in the above equation is reduced and the allowable $V_{DS}$ that maintains the transistors in saturation is limited, $I_{DS}$ is subject to large variations.

Figure 2:
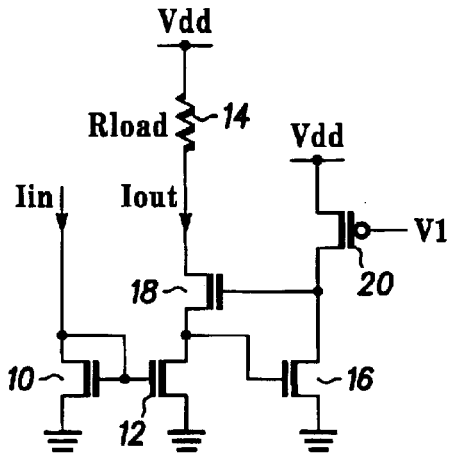
FIG. 2 is another prior art current mirror/current source circuit.

To reduce the $I_{DS}$ variations with $V_{DS}$, the circuit shown in FIG. 2 provides active feedback. As compared to the circuit shown in FIG. 1, transistor 16 is added to maintain a constant $V_{DS}$ at the drain of transistor 12 (and source of transistor 18), with the load variation, noise, and power supply variation, therefore achieving the goal of maintaining a constant output current $I_{out}$. Transistor 18 provides the current mode output and, together with transistors 16 and 20 constitutes an active feedback amplifier.

Note that the operation of the current source/current mirror shown in FIG. 2 is limited only to circuits using a large power supply, first, because the $V_{DS}$ of transistor 10 can not be decreased below $1V_T$ and second because an output voltage swing for the current mirror has to be provided. Typical operation of this circuit is for a power supply voltage $V_{DD}$ greater than $6V_T$. For example, with a $V_{DD}$ of 2.0 volts, the VSD of transistor 12 may be 0.6V and of transistor 18, 0.2V. Those drops leave only 1.2V of signal swing. To obtain a usable voltage swing of 1.8V or more, a $V_{DD}$ of 2.6V or more is needed.

Figure 3:
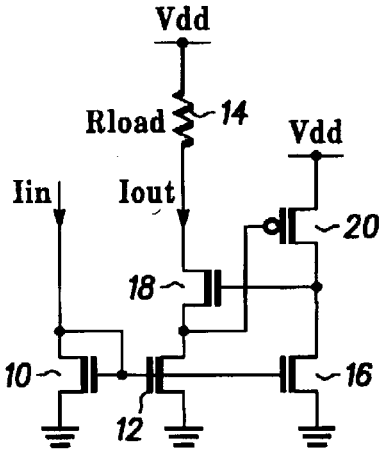
FIG. 3 is a current mirror/current source circuit in accordance with the instant invention.

The circuit shown in FIG. 3 is a basic current source/current mirror according to the present invention. This circuit is designed to operate with a power supply as low as $1.25V_T$. The p-channel transistor 20 has its gate coupled between the source of transistor 18 and the drain of transistor 12, and the gate of transistor 16 is coupled to the gate of transistor 12. Coupling the gate of transistor 20, which is a biasing transistor, to the node between transistors 12 and 18 maintains the node at a relatively constant voltage. The $V_{DS}$ of transistor 12 is designed so that transistor 12 is maintained in saturation at all times, or, $V_{DS}>V_{GS}-V_T$.

Note that, for example, if, for transistor 12, $V_{GS}$=0.5 volts and $V_T$=0.4 volts, $V_{DS}$ at the drain of transistor 12 can be as low as 0.1 volt. This bias situation provides a high voltage swing for the output while operating at low power supply voltages, while at the same time insuring high accuracy and a constant output current. For example, if VDD is 0.8V, and the VDS of transistors 12 and 18 are each 0.1V, that leaves 0.6V for signal voltage across the load 14. Transistors 16, 18, and 20 maintain a constant $V_{DS}$ for transistor 12 independent of load variations, noise, or power supply variations. However, the sensitivity of the output current to power supply variations for the circuit shown in FIG. 3 is important since a power supply variation is reflected directly into the $V_{DS}$ of transistor 12 through the $V_{GS}$ of transistor 20, being only reduced by the gain of transistor 20.

Figure 4:
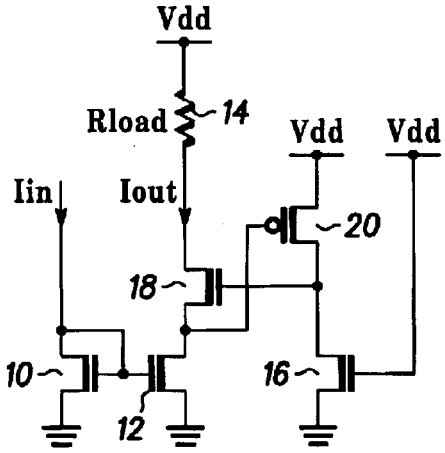
FIG. 4 is a current mirror/current source circuit in accordance with an alternative embodiment of the instant invention.

The power supply rejection ratio (PSSR) of the circuit of FIG. 3 can be improved if transistor 16 is biased as shown in FIG. 4. The circuit of FIG. 4 introduces a feedback that monitors and compensates for power supply variations. Instead of taking a bias voltage from transistor 20 as shown in FIG. 3, the gate of transistor 16 is coupled directly to $V_{DD}$. The voltage variation at the node between the source of transistor 18 and drain of transistor 12 is therefore synchronized with $V_{DD}$ variations.

Figure 5:
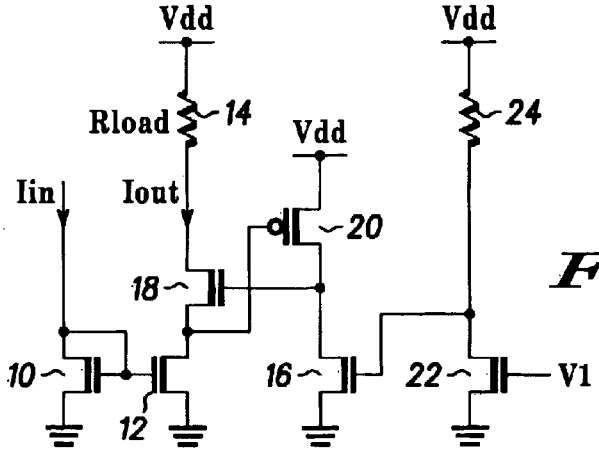
FIG. 5 is a current mirror/current source circuit in accordance with an alternative embodiment of the instant invention.

The feedback introduced for the circuit shown in FIG. 4 may be further improved by the circuit shown in FIG. 5. Transistor 22, together with the resistor 24, introduces the right amount of feedback so that theoretically the output current variations generated by the power supply variations can be reduced to zero. In FIG. 4 the gain is produced by transistor 16 alone. In the circuit of FIG. 5, transistor 22 and resistor 24 contribute as well. The use of resistor 24 to provide the right amount of feedback is required due to the reduced power supply. However, incorporating resistors typically requires a more expensive technology, therefore, a solution to eliminate the use of resistors is preferred.

Figure 6:
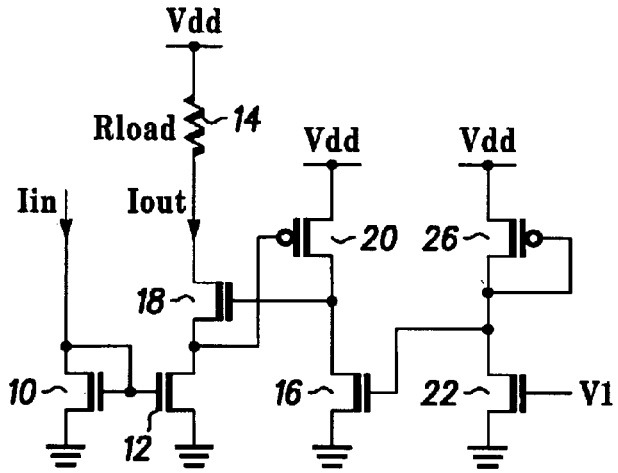
FIG. 6 is a current mirror/current source circuit in accordance with an alternative embodiment of the instant invention.

Such a circuit is described in FIG. 6. The resistor 24 from FIG. 5 can be replaced by transistor 26, as shown in FIG. 6. This however requires a power supply of between $2V_T$ and $3V_T$, since an additional $V_{GS}$ drop is incurred by transistor 26.

Figure 7:
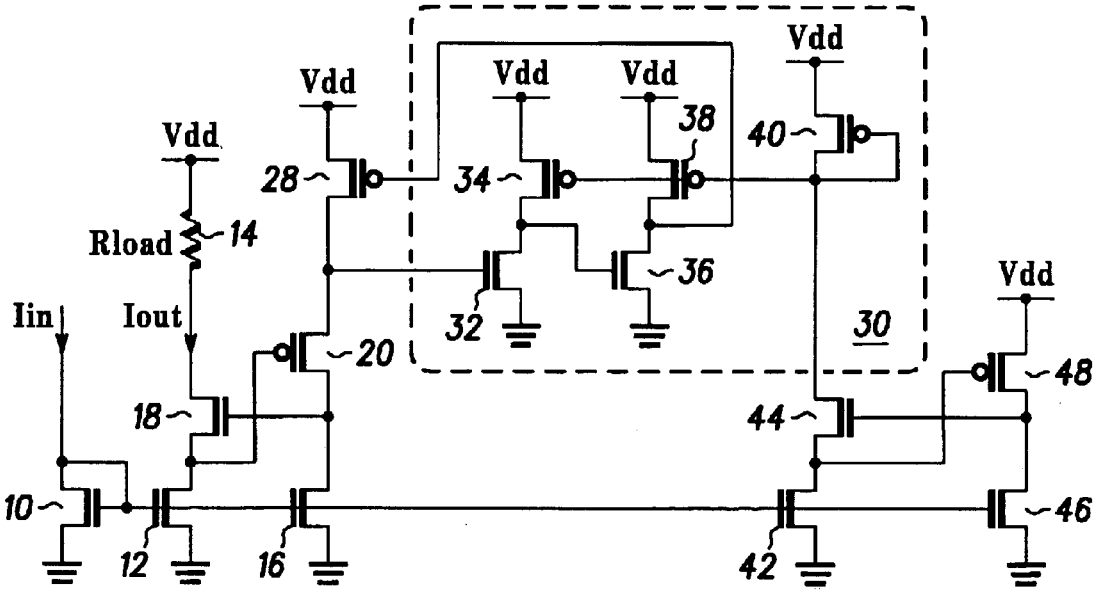
FIG. 7 is a current mirror/current source circuit in accordance with an alternative embodiment of the instant invention.

The circuit shown in FIG. 7 is designed to operate with a power supply as low as $1.4V_T$. The major improvement in this circuit over that of FIG. 3 is brought about by the introduction of transistor 28, which may be referred to as a spring transistor, and an amplifier 30. The goal of the spring transistor 28 is to reduce power supply variations by tracking $V_{DD}$ and in conjunction with amplifier 30, creating a virtual $V_{DD}$ at the node between the drain of transistor 28 and the source of transistor 20. The amplifier 30 consists of transistors 32, 34, 36, 38, and 40.

The amplifier 30, for accuracy and power supply compatibility reasons, is biased by a current source comprising transistors 42, 44, 46, and 48 in a configuration similar to that of the biasing circuit of FIG. 3, which biases transistor 40. Note that the amplifier 30 provides control for, and regulates the operating point of transistor 28, since it is placed in a feedback loop with respect to transistor 28. In other words, the goal of the amplifier is to provide a constant $V_{GS}$ for transistor 32, a $V_{GS}$ that is intended to be highly insensitive to power supply variations and noise. The magnitude of this $V_{GS}$ is of great importance for low power supply operation. The $V_{GS}$ of transistor 32 must be designed such that for the estimated power supply variations, the voltage in the source of transistor 20 does not go below the nominal voltage that is required to maintain transistor 12 in saturation and provide the required accuracy for the output current, while, for the entire range of power supply variation, transistor 28 is maintained in saturation or at the limit between saturation and linear. The latter condition is imposed in order to minimize the voltage swing in the drain of transistor 36 with the power supply variations, and therefore minimize the $V_{GS}$ variations of transistor 32 with the power supply variations.

Figure 8:
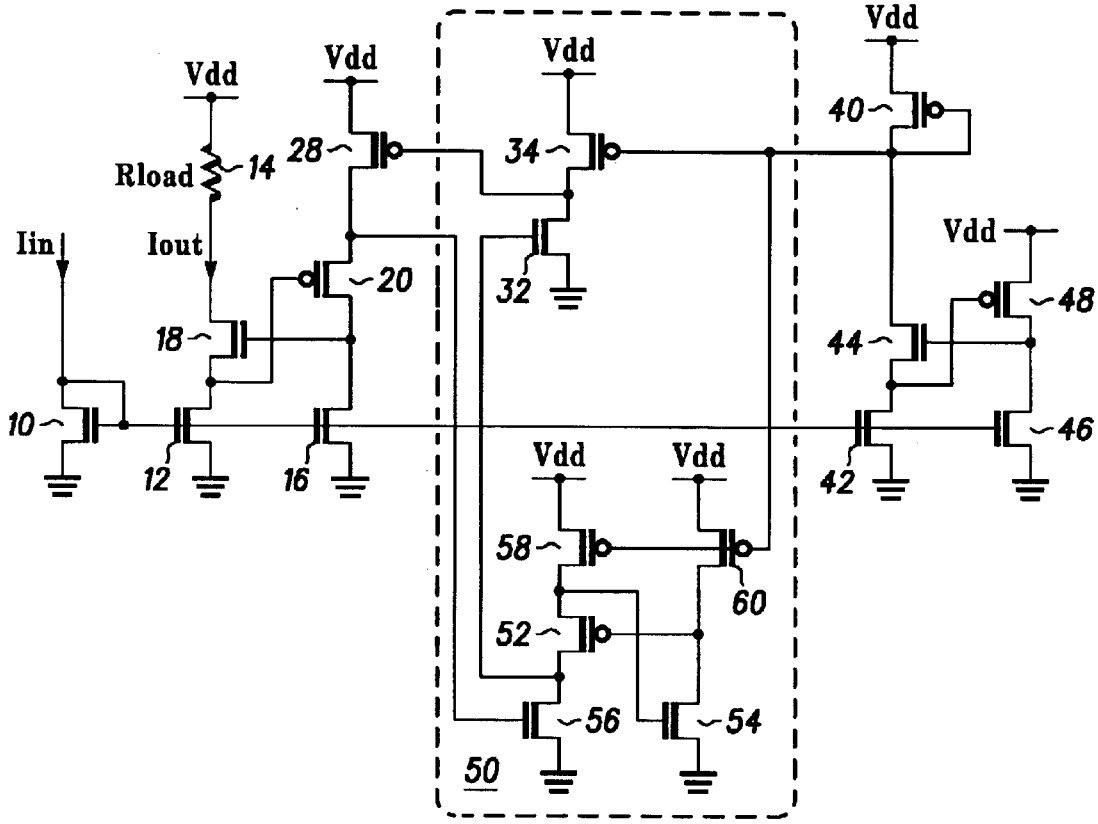
FIG. 8 is a current mirror/current source circuit in accordance with an alternative embodiment of the instant invention.

The power supply rejection ratio of the circuit shown in FIG. 7 may be further improved by the circuit shown in FIG. 8 by increasing the gain of the amplifier that controls and regulates the operating point of transistor 28. Note that the amplifier 50 consists now of transistors 32, 34, 52, 54, 56, 58, and 60. The latter five transistors represent a current source similar to the circuit shown in FIG. 3, where transistor 56 is the load. The constancy of the virtual power supply in the source of transistor 20 is thus further improved. The biasing circuit comprising transistors 40, 42, 44, 46, and 48 is similar to the circuit with like components in FIG. 7.

Note that with any of the disclosed circuits, transistor 20 can never be biased to operate in the saturation region. In the best case, transistor 20 can operate on the boundary between the saturation and linear regions. While transistor 20 is typically linear, any $I_{DS}$ and $V_{DS}$ variations for transistor 20 have a larger impact on the $V_{DS}$ of transistor 12 and ultimately on the output current, than if when transistor 20 is saturated. A solution to this problem is provided according to the circuit shown in FIG. 9. Transistor 62 provides the appropriate highly constant bias for both transistors 16 and 20.

Figure 9:
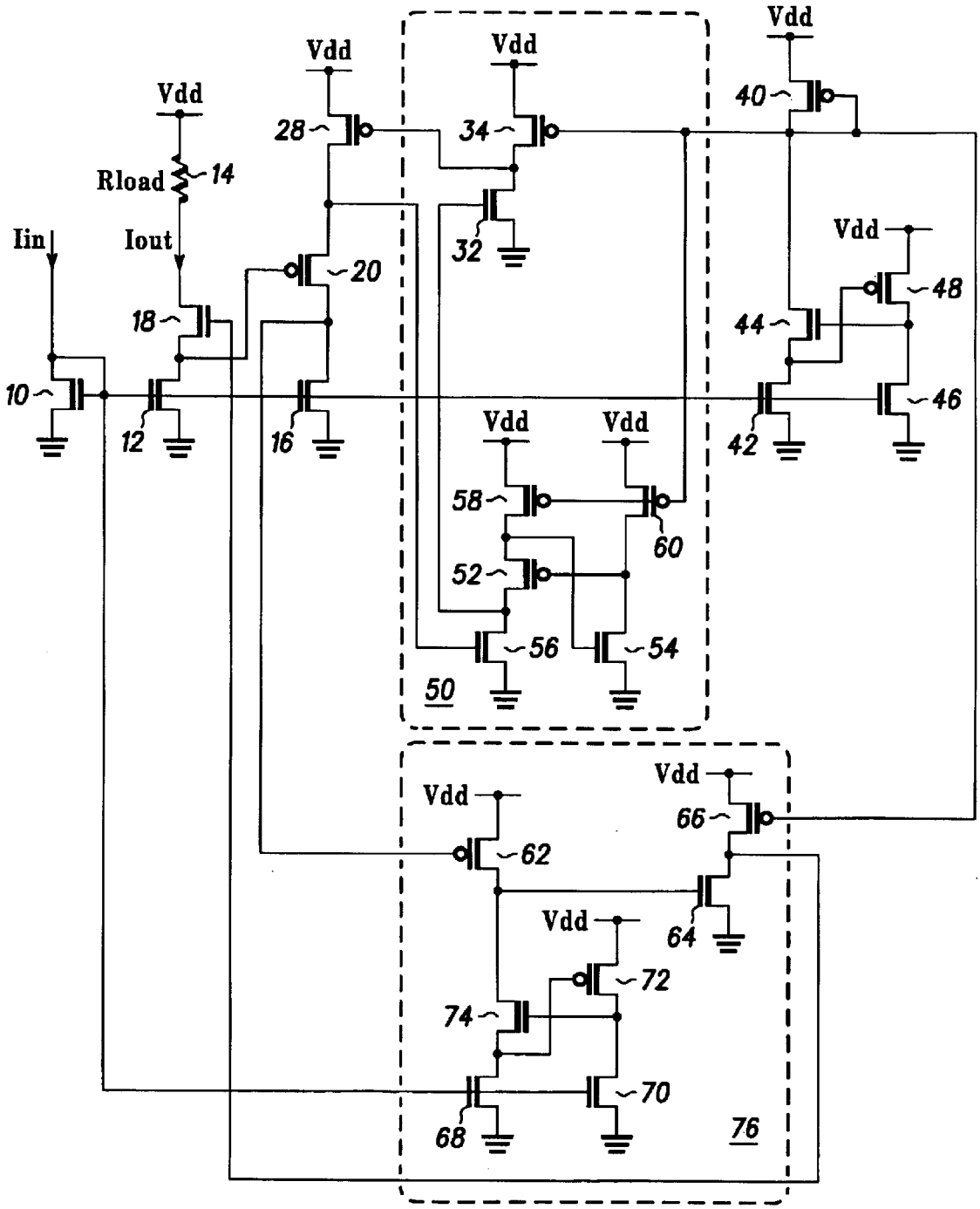
FIG. 9 is a current mirror/current source circuit in accordance with an alternative embodiment of the instant invention.

The circuit of FIG. 9 addresses the load variations through a feedback amplifier consisting of transistors 12, 16, 18, and 20. The gain of this amplifier, while sufficient for many applications, is limited. The circuit shown in FIG. 9 increases this gain, which provides high accuracy for the output current of the current source/current mirror circuit. In between transistors 18 and 20, an additional amplifier 76 of significant gain is introduced. The amplifier consists of transistors 62, 64, 66, 68, 70, 72, and 74. The gate of transistor 18 is applied as an input to amplifier 76, which creates a voltage level ($V_{GS}$ of transistor 62) sufficient to keep transistor 16 in saturation at all times.

Figure 10:
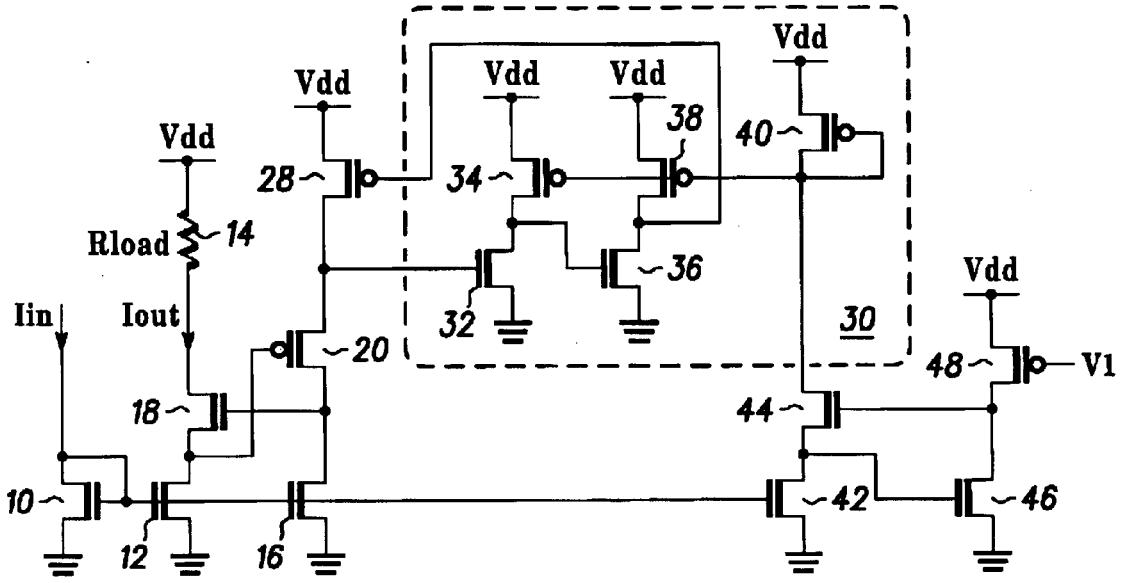
FIG. 10 is a current mirror/current source circuit in accordance with an alternative embodiment of the instant invention.

While the circuit techniques of this invention can be extended to any current source/current mirror that employs active feedback independent of power supply, operation at low power supply voltages creates additional constraints. For example, the circuit shown in FIG. 10 represents a current source/current mirror that operates at large power supplies (larger than $2V_T$) while providing high accuracy for a high output voltage swing. The circuit is similar to that of FIG. 7 except that, in order to permit high-voltage operation, transistor 40 is biased with a current source according to FIG. 2 instead of a current source according to FIG. 3.

Figure 11:
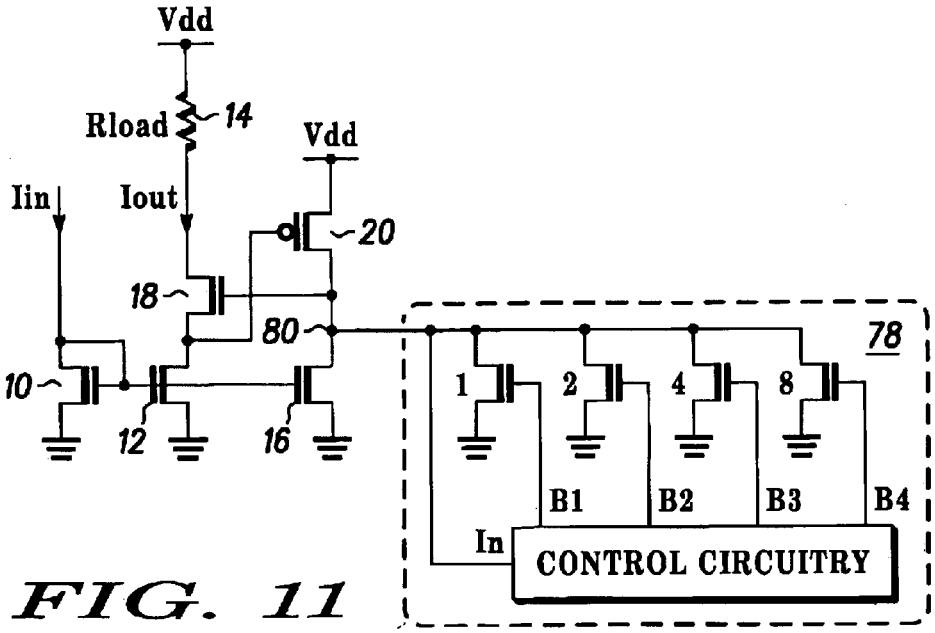
FIG. 11 is a current mirror/current source with a self-correcting feedback control loop.

Any of the above circuits according to the present invention provide the possibility of self-correcting the accuracy of the output current. This is a highly useful capability especially at such low power supplies where on-chip noise may induce large errors. The self correcting facility is also useful in pulling the output current to a specific desired value, therefore compensating for process parameter variations and matching errors. The principle of this self-correcting technique is shown in FIG. 11 taken in conjunction with the circuit of FIG. 3. A feedback control loop 78 is placed between an input node 80 that is monitored and an output node that contributes to keeping the circuit in a desired state. The optimal input and output nodes for the feedback control loop in this particular case coincide. However, for different implementations according to the present invention, the optimal input and output nodes for the feedback control loop may be different. The control circuitry may contain a programmable comparator. For steady-state nominal operation, the output of the comparator controls the output node of the feedback loop to bias transistor 20 so that the desired output current is generated at the output of the current mirror/current source, $I_{out}$. Any perturbation on the input node of the feedback loop modifies the output of the comparator, which modifies the bias point of transistor 20 which maintains the output current $I_{out}$ to the desired value. Note also that this technique may provide similar accuracy for a simpler circuit (such as shown in FIG. 3) implementing this technique with a more complex circuit (such as shown in FIG. 9) that does not implement this technique.

While several exemplary embodiments have been presented in the foregoing detailed description of the invention, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A current generator circuit having an output for providing a reference current comprising:

a first reference transistor of a first type having a gate coupled for receiving a reference voltage, a drain, and a source coupled for receiving a first power supply voltage;

a second reference transistor of said first type having a gate coupled for receiving said reference voltage, a drain, and a source coupled for receiving said first power supply voltage;

a bias transistor of a second type having a gate coupled to said drain of said first reference transistor, a drain coupled to said drain of said second reference transistor, and a source coupled for receiving a second power supply voltage; and a buffer transistor of said first type having a gate coupled to said drain of said second reference transistor, a drain coupled to the output of the current generator circuit, and a source coupled to said drain of said first reference transistor.

2. A current generating circuit as set forth in claim 1 wherein the gate of the second reference transistor is adapted to be connected to the second power supply voltage.

3. A current generating circuit as set forth in claim 1 further including:

a transistor of said second type having a gate, a drain coupled to said source of said bias transistor, and a source coupled for receiving said second power supply voltage; and an amplifier having an input coupled to said drain of said transistor and an output coupled to said gate of said transistor.

4. A current generating circuit as set forth in claim 1 further including a transistor of said first type having a gate and a drain coupled in common for receiving a vias current, and a source coupled for receiving said first power supply voltage wherein said gate and drain of said transistor is coupled to provide said reference voltage.

5. A current generating circuit as set forth in claim 1 further including:

a transistor of said second type having a gate, a drain coupled to said source of said bias transistor, and a source coupled for receiving said second power supply voltage;

a first amplifier having an input coupled to said drain of said transistor and an output coupled to said gate of said transistor; and a second amplifier having an input coupled to said drain of said second reference transistor and an output coupled to said gate of said second reference transistor.

6. A current generating circuit as set forth in claim 5 wherein said first amplifier comprises:

a first transistor of said second type having a gate coupled for receiving a second reference voltage, a drain, and a source coupled for receiving said second power supply voltage;

a second transistor of said first type having a gate coupled to said input of said first amplifier, a drain coupled to said drain of said first transistor, and a source coupled for receiving said first power supply voltage;

a third transistor of said second type having a gate coupled for receiving said second reference voltage, a drain coupled to said output of said first amplifier, and a source coupled for receiving said second supply voltage; and a fourth transistor of said first type having a gate coupled to said drain of said second transistor, a drain coupled to said output of said first amplifier, and a source coupled for receiving said first supply voltage.

7. A current generating circuit as set forth in claim 5 wherein said second amplifier comprises:

a first transistor of said first type having a gate coupled for receiving said first reference voltage, drain coupled, and a source coupled for receiving said first power supply voltage;

a second transistor of said first type having a gate, a drain, and a source coupled to said drain of said first transistor;

a third transistor of said second type having a gate coupled to said input of said second amplifier, a drain coupled to said drain of said second transistor, and a source coupled for receiving said second power supply voltage;

a fourth transistor of said first type having a gate coupled for receiving said first reference voltage, a drain coupled to said gate of said second transistor, and a source coupled for receiving said first power supply voltage;

a fifth transistor of said second type having a gate coupled to said drain of said first transistor, a drain coupled to said drain of said fourth transistor, and a source coupled for receiving said second power supply voltage;

a sixth transistor of said first type having a gate coupled to said drain of said second transistor, a drain coupled to said output of said second amplifier, and a source coupled for receiving said first power supply voltage; and a seventh transistor of said second type having a gate coupled for receiving said second reference voltage, a drain coupled to said output of said second amplifier, and a source coupled for receiving said second power supply voltage.

8. A current generator circuit having an output for providing a reference current comprising:

a first transistor of a first type having a first electrode coupled to the output of the current generator circuit, a control electrode, and a second electrode;

a second transistor of said first type having a first electrode coupled to said second electrode of said first transistor, a control electrode coupled for receiving a first reference voltage, and a second electrode coupled for receiving a first power supply voltage;

a third transistor of said first type having a first electrode coupled to said control electrode of said first transistor, a control electrode coupled for receiving said first reference voltage, and a second electrode coupled for receiving said first power supply voltage;

a fourth transistor of a second type having a first electrode coupled to said first electrode of said third transistor, a control electrode coupled to said first electrode of said second transistor, and a second electrode;

a fifth transistor of said second type having a first electrode coupled to said second electrode of said fourth transistor, a control electrode, and a second electrode coupled for receiving a second power supply voltage; and a first amplifier having an input coupled to said first electrode of said fifth transistor and an output coupled to said control electrode of said fifth transistor.

9. A current generating circuit as set forth in claim 8 further including a sixth transistor of said type having a first electrode and a control electrode coupled in common for receiving a bias current, and a second electrode coupled for receiving said first power supply voltage wherein said sixth transistor provides said first reference voltage.

10. A current generating circuit as set forth in claim 8 wherein a voltage at said first electrode of said second transistor is substantially constant.

11. A current generating circuit as set forth in claim 10 wherein said control electrode of said third transistor is adapted to be connected to said second power supply voltage.

12. A current generating circuit as set forth in claim 8 further comprising a second amplifier having an input and an output, the output of the second amplifier being coupled to said control electrode of said first transistor and the input of the second amplifier being coupled to the first electrode of said third transistor.

13. A current generator circuit having an output for providing a reference current comprising:

a first transistor of a first electrode coupled to the output of the current generator circuit, a control electrode, and a second electrode;

a second transistor of said first type having a first electrode coupled to said second electrode of said first transistor, a control electrode coupled for receiving a first power supply voltage;

a third transistor of said first type having a first electrode, a control electrode coupled for receiving said first reference voltage, and a second electrode coupled for receiving said first power supply voltage;

a fourth transistor of a second type having a first electrode coupled to said first electrode of said third transistor, a control electrode coupled to said first electrode of said second transistor, and a second electrode;

a fifth transistor of said second type having a first electrode coupled to said second electrode of said fourth transistor, a control electrode, and a second electrode coupled for receiving a second power supply voltage;

a first amplifier having an input coupled to said first electrode of said fifth transistor and an output coupled to said control electrode of said fifth transistor; and a second amplifier having an input coupled to said first electrode of said third transistor and an output coupled to said control electrode of said first transistor.

14. The current generator circuit of claim 13 wherein said second amplifier outputs a voltage to said control electrode of the first transistor such that said second transistor has a $V_{ds}$ approximately equal to $V_{gs}-V_t$ wherein the first transistor and second transistor both operate in saturation while providing said reference current.

* * * * *

UNITED STATES PATENT AND TRADEMARK OFFICE

CERTIFICATE OF CORRECTION

PATENT NO. : 6,788,134 B2
DATED : September 7, 2004
INVENTOR(S) : Radu Secareanu It is certified that error appears in the above-identified patent and that said Letters Patent is hereby corrected as shown below:

Column 6,
Line 31, delete “vias” and add -- bias --;

Column 8,
Line 25, after “of a first” add -- type having a first --;
Line 31, after “first” add -- reference voltage, and a second electrode coupled for receiving a first --.

Signed and Sealed this

First Day of February, 2005

JON W. DUDAS
*Director of the United States Patent and Trademark Office*